US007410419B2

(12) United States Patent
Fiden

(10) Patent No.: US 7,410,419 B2
(45) Date of Patent: Aug. 12, 2008

(54) GAMING MACHINE HAVING A CRAP SLOT GAME PLAY SCHEME

(75) Inventor: Daniel P Fiden, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 518 days.

(21) Appl. No.: 10/872,889

(22) Filed: Jun. 21, 2004

(65) Prior Publication Data

US 2005/0282606 A1 Dec. 22, 2005

(51) Int. Cl.
*A63F 9/24* (2006.01)

(52) U.S. Cl. ..... 463/20; 463/16; 463/17; 463/18; 463/19; 463/21; 463/22; 463/30

(58) Field of Classification Search ..... 463/1, 463/10–13, 16–26, 30–31, 36–38, 40, 43, 463/46; 273/138.1, 138.2, 139, 142 R, 143 R, 273/292

See application file for complete search history.

(56) References Cited

U.S. PATENT DOCUMENTS 5,823,872 A * 10/1998 Prather et al. ..... 463/6
6,568,680 B1 * 5/2003 Moody et al. ..... 273/292
6,890,255 B2 * 5/2005 Jarvis et al. ..... 463/17
2002/0151360 A1 * 10/2002 Durham et al. ..... 463/30
2002/0173353 A1 * 11/2002 Thomas ..... 463/17
2003/0060267 A1 * 3/2003 Glavich et al. ..... 463/20
2005/0245307 A1 * 11/2005 Gatto et al. ..... 463/16

* cited by examiner

*Primary Examiner*—John M Hotaling, II
*Assistant Examiner*—Steven J. Hylinski
(74) *Attorney, Agent, or Firm*—Nixon Peabody LLP

(57) ABSTRACT

The present invention is a gaming machine and method for conducting a crap slot game. The gaming machine includes a first display for displaying a slot game outcome and a second display for displaying a player interactive wagering interface. The method includes detecting selection of a first wager amount from a number of displayed wager amounts, detecting selection of a first wager cell from a displayed assemblage of wager cells. Each of the wager cells corresponds to one of a number of winning game outcomes having respective value payout ratios. The method further includes displaying the first wager amount in the first wager cell, displaying the game play outcome of the wagering game on the first display and awarding a value payout to the player if the game play outcome includes the winning game outcome corresponding to the first wager cell.

23 Claims, 7 Drawing Sheets

GAMING MACHINE HAVING A CRAP SLOT GAME PLAY SCHEME

FIELD OF THE DISCLOSURE

This invention is directed to gaming machines, and more particularly, to a gaming machine having a crap slot game play scheme.

BACKGROUND

Casinos and other gaming establishments often include both gaming machines, for example, slot machines providing slot games and gaming tables providing table games such as craps. As a result, many game play options are available to patrons of the gaming establishments. Interestingly, whether due to human nature, risk tolerance, economics, skills, game familiarity, etc., it has been observed that some patrons consistently prefer gaming machine play while others prefer table game play. Shrewd gaming establishment operators consequently strive to offer a proper balance between entertaining and exciting gaming machines that encourage frequent and extended play, and fast paced gaming tables offering games such as blackjack, roulette, craps, keno, baccarat, etc where wagering amounts per game are often substantial.

As is known, a gaming machine may be configured as a video gaming machine to provide video slots, video poker, video blackjack, video keno, video bingo, video pachinko, video lottery, etc., or as an electro-mechanical machine to provide a spinning reel slots game. As is also known, video gaming machines include at least one video display for displaying video game images (e.g., simulated reel symbol arrays, simulated cards, simulated numbers, etc.) and may additionally include a touch screen to allow player interaction. Mechanical spinning reel slot machines generally do not include a video display and instead, include a main reel display area configured to allow a player to view a reel symbol array provided by stopped mechanical spinning reels. In either case, the popularity of gaming machines with players is often dependent on the likelihood (or perceived likelihood) of winning money at the gaming machine and the intrinsic entertainment value of the gaming machine relative to other available gaming options. Where the available gaming options include a number of competing gaming machines and the expectation of winning on each machine is roughly the same (or believed to be the same), players are more likely to be attracted to the most entertaining and exciting of the machines. Accordingly, popular game themes and/or secondary or bonus games added to the base games have become common place in an attempt to attract players and provide an additional level of excitement to game play.

SUMMARY OF THE INVENTION

In general, the present invention provides a gaming machine having a crap slot game play scheme whereby gaming machine play includes elements of gaming table play. As a result, patrons that have traditionally shied away from table game play may experience excitement typically associated with table game play, while the patrons that have traditionally preferred only table game play are lured to gaming machines incorporating table game play such as the gaming machine having crap slot game play schemes disclosed herein. In addition, the gaming machine having a crap slot game play scheme encourages increased wagering amounts per game by allowing the player to make multiple wagers on respective different potential game outcomes, for example, different symbol combinations on different pay lines of a game outcome symbol array of a slot game.

Although described as a slot game play scheme, it is contemplated that the crap slot game play scheme disclosed herein may also be configured for other wagering game play including bonus game play.

The present invention is a gaming machine and method for conducting a crap slot game. The gaming machine includes a first display for displaying a slot game and a second display for displaying a player interactive wagering interface. The method includes detecting selection of a first wager amount from a number of wager amounts displayed on the wagering interface, detecting selection of a first wager cell from an assemblage of wager cells displayed on the wagering interface where each of the wager cells corresponds to one of a number of winning game outcomes and each of the winning game outcomes has a respective value payout ratio. The method further includes displaying the first wager amount in the first wager cell, displaying the game play outcome of the wagering game on the first display and awarding a value payout to the player if the game play outcome includes the winning game outcome corresponding to the first wager cell.

Additional aspects of the invention will be apparent to those of ordinary skill in the art in view of the detailed description of various embodiments, which is made with reference to the drawings, a brief description of which is provided below.

DESCRIPTION OF THE PREFERRED EXAMPLES

Figure 1:
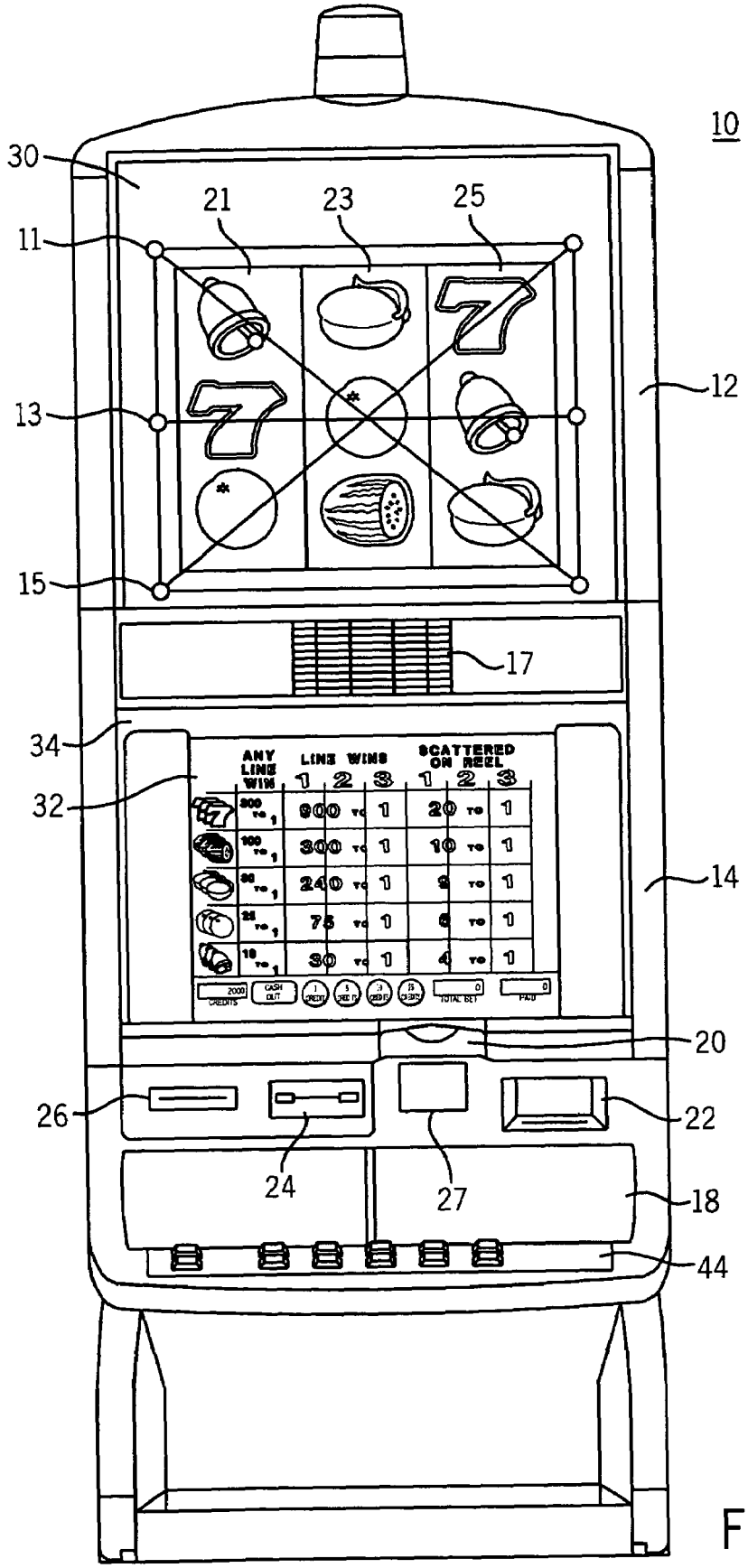
FIG. 1 is a perspective view of an embodiment of a gaming machine having a crap slot game play scheme in accordance with an embodiment of the invention.

The description of the preferred examples is to be construed as exemplary only and does not describe every possible embodiment of the invention. Numerous alternative embodiments could be implemented, using either current technology or technology developed after the filing date of this patent, which would still fall within the scope of the claims defining the invention.

In general, the present invention provides a gaming machine having a crap slot game play scheme that combines elements of gaming machine play with elements of gaming table play to increase player flexibility and control in wagering and game play. As described below, the present invention is preferably implemented using a video slot machine having a first video display screen for displaying a slot game and having a second video display screen for displaying a wagering interface that includes a touch screen to enable player selection of one or more of a number of wagers. The wagering interface is preferably configured as an assemblage of player selectable wager cells arranged in a grid pattern where each of the wager cells is defined by a combination of at least one reel symbol and at least one position of that reel symbol(s) in the reel symbol array of the game outcome ("game outcome symbol array"). Each wager cell represents one winning game outcome and each winning game outcome (e.g., an occurrence of three like symbols on a pay line, an occurrence of a selected symbol on a particular reel) has a corresponding value payout ratio that is displayed via the wager interface on their respective wager cells. The value payout ratios are based on a probability of an occurrence of the symbol and position combination of each of the respective wager cells in the game outcome symbol array.

It is contemplated that the present invention may also be implemented using other suitable gaming machine having other suitable displays. Moreover, although preferably implemented using two displays, it is contemplated that the gaming machine having a crap slot game play scheme may be implemented using one video display configured to display both the wagering game and the wagering interface, or a mechanical display configured to display the wagering game overlaid by a flat panel transmissive display configured to display the wagering interface.

A mechanical spinning reel gaming machine with superimposed video images generated via a flat panel transmissive display is described in U.S. Pat. No. 6,517,433, entitled "Reel Spinning Slot Machine With Superimposed Video Image", naming Loose et al. as inventors, filed May 22, 2001, and herein incorporated by reference in its entirety.

An advantageous feature of the gaming machine having a crap slot game play scheme is that patrons that have traditionally shied away from table game play can experience the excitement typically associated with table game play, while the patrons that have traditionally preferred only table game play may be lured to the gaming machine providing crap slot game play as disclosed herein. Although described as a base game play scheme, it is contemplated that the crap slot game play scheme disclosed herein may also be configured for bonus game play.

FIG. 1 is a perspective view of a gaming machine 10 providing crap slot game play in accordance with an embodiment of the invention. The gaming machine 10 may be configured as a stand-alone machine (that may or may not be coupled to a backroom computer) where the outcome of game play is locally determined, or it maybe configured as part of a server-based gaming network where the outcome of game play is either locally determined or centrally determined.

The gaming machine 10 may be any type of slot machine adapted to provide crap slot game play and may therefore have varying structures and methods of operation. For example, in one embodiment, the gaming machine 10 may be a video slot machine having two video display screens where one of the video display screens displays a slot game and the other video display screen includes a touch screen for player inputs. In another embodiment, the slot game may be provided via mechanical spinning reel rather than the video display screen. In addition, rather than providing a slot game, the gaming machine 10 may be configured to provide a bingo game, a blackjack game, a poker game, a keno game, to name a few. For exemplary purposes, various elements of the gaming machine 10 are described below, but it should be understood that numerous other elements may exist and may be utilized in any number of combinations to create a variety of gaming machine types.

Referring to FIG. 1, the gaming machine 10 includes a cabinet 12 having a door 14 to provide access to the interior of the gaming machine 10. Attached to the door 14 are one or more audio speaker grill(s) 17 and a belly glass area 18 that typically displays game theme artwork. Sounds provided via the audio speaker grill 17 and associated audio speakers may include the sound of spinning slot machine reels, a dealer's voice, music, announcements or any other audio related to the wagering game.

Also attached to the door 14 are a number of value input devices that allow a player to insert value for game play. The value input devices may include a coin slot acceptor 20 and/or a note acceptor 22 to input gaming tokens, coins, paper currency, ticket vouchers, credit or debit cards, smart cards, and any other object representative of value (i.e., value input) for game play on the gaming machine 10. The gaming machine 10 also includes a player tracking area that may have a card reader 24, a printer 26 and a small display 27 (e.g., a small display reflecting coin denomination). A player control panel 44 may also be provided with a number of pushbuttons or touch-sensitive areas (i.e., touch screen) that may be pressed by a player to select games, make wagers, make gaming decisions, etc.

In the illustrated example of FIG. 1, the gaming machine 10 includes two video displays. The first video display 30 is adapted to display a wagering game, preferably a slot game having a number of winning game outcomes. The second video display 32 having touch screen capability, is adapted to provide a wagering interface 34 that enables player selection of one or more wagering amounts and one of more wager cells displayed on the wagering interface 34. Although preferably implemented as a thin film transistor liquid crystal display (TFT-LCD), the first and second video displays 30, 32 may be implemented as a CRT, a VFD, a plasma display, an organic liquid crystal display or other type of video display suitable for use in a gaming machine.

In another embodiment, the first video display 30 may be replaced by a number of mechanical spinning reels displaying a reel symbol array of artwork and blank symbols to the player. Similarly, the second video display 32 may be replaced by a flat panel transmissive display. It is further contemplated that either the first and/or second video display screen may be replaced by a mechanical display (e.g., a mechanical spinning reel display) that may or may not include a flat panel transmissive display positioned in front of the mechanical display where the flat panel transmissive display is able to superimpose video images upon the mechanical display. In addition, rather than providing the wagering interface 34 in conjunction with a slot game, the gaming machine 10 may be configured to provide the wagering interface 34 in conjunction with a bingo game, a blackjack game, a poker game, a keno game, to name a few.

As mentioned above, the first video display 30 is adapted to display a slot game and the second video display 32 having touch screen capability, is adapted to provide the wagering interface 34. In the illustrated example, the slot game shown on the first video display 30 includes three video reels 21, 23 and 25, and three pay lines 13, 11 and 15. Reel symbols of the illustrated slot game include a bell, a "7", a watermelon, an orange, and a plum. Other reels symbols may also be utilized, depending on the game theme.

As shown in FIG. 1, the wagering interface 34 enables player selection of a wager amount from among a displayed plurality of wager amounts (e.g., 1 credit, 5 credits, 10 credits, 25 credits), and enables player selection of one or more wager cells of an assemblage of displayed wager cells. The assemblage of wager cells is preferably arranged in a grid pattern having a number of rows and columns where each of the wager cells is defined by one row and one column. Each of the number of rows corresponds to a variation of a first aspect of the winning game outcomes and each of the columns corresponds to a variation of a second aspect of the winning game outcomes. Thus, each wager cell corresponds to one winning game outcome where the one winning game outcome is defined by the respective row and column. As described in detail below, if a wager is placed on a particular wager cell and the subsequent game outcome symbol array includes the winning game outcome defined by the row and column of that particular wager cell, the player is awarded a value output.

In the case of slot game play, each of the wager cells is preferably defined by (1) one of a variation of one or more reel like symbols at (2) one of a variation of positions in the game outcome symbol array of the slot game. For example, a selected wager cell may be defined by (1) a combination of three like reel symbols displayed (2) on a diagonal pay line of a game outcome symbol array. If a wager is placed on the selected wager cell and the game outcome symbol array includes the three like symbols on the diagonal pay line, the player is awarded a value output. For other wagering game play (e.g., poker play, blackjack play. etc.), each of the wager cells may be defined by a card suit (row) and a winning hand (column) for example, a pair, a flush, etc.

Each of the winning game outcomes, represented by a respective wager cell, includes a corresponding value payout ratio (e.g., 1 to 20, 1 to 100) that is based upon a probability of an occurrence of the winning game outcome in the game outcome symbol array. The value payout ratios are preferably displayed via the wagering interface 34 in conjunction with their respective wager cells to enable the player to easily associate a particular a value payout ratio to a particular wager cell and therefore, to a particular winning game outcome. Although the value payout ratio associated with particular wager cell is not varied during an individual game, a value payout associated with an occurrence of the respective winning game outcome in the game outcome symbol array of the individual game may vary depending on the wager amount selected by the player.

Wagering Interface—Assemblage of Wager Cells

Figure 2:
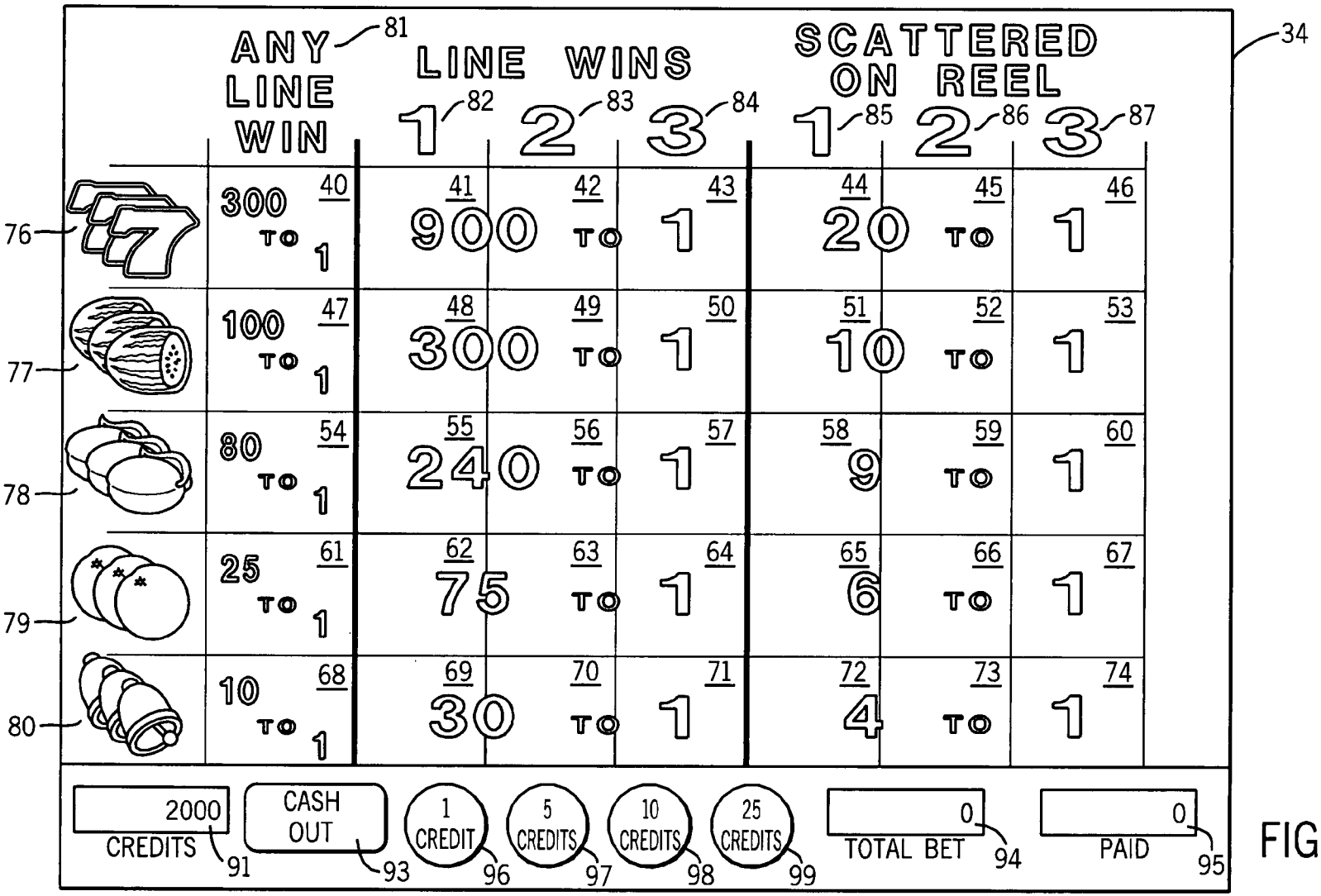
FIG. 2 is an exemplary wagering interface of the gaming machine of FIG. 1 in accordance with an embodiment of the invention.

For example, FIG. 2 is a more detailed view of the wagering interface 34 of the gaming machine of FIG. 1. The wagering interface 34 includes a five row (numbered 76 through 80) by seven column assemblage (numbered 81 through 87) of thirty-five wager cells 40-74 arranged in a grid pattern. As illustrated, each of the rows 76-80 corresponds to a different reel symbol where an occurrence of groups of like reel symbols or selected individual "scattered" symbols may be included in a winning game outcome. For example, row 76 corresponds to a 7"-symbol "where an occurrence of three 7-symbols along a selected pay line or an occurrence of one 7-symbol on a selected reel yields a winning game outcome and may yield a value payout to the player if a wager was placed on the respective wager cell. Similarly, row 78 corresponds to a "plum" reel symbol where an occurrence of three plum reel symbols along a selected pay line or an occurrence of one plum symbol displayed on a selected stopped reel yields a winning game outcome. It is contemplated that each of the rows may also correspond to one of a number other reel symbols or reel symbol combinations (e.g., selected symbol combinations, other winning symbol combinations), or in the case of another wagering game, one of any number of images, symbols and other indicia such as characters, people, places, things, etc.

As is also illustrated, each of the columns 81-87 preferably corresponds to at least one reel symbol position of the reel symbol positions of the game outcome symbol array. For example, column 81 corresponds to "any line win" of any of the first pay line 13, the second pay line 11, and the third pay line 15 that includes a selected symbol combination defined by the intersecting row of the respective wager cell 40, 47, 54, 61, or 68. Thus, the column 81 corresponds to each of the three reel symbol positions of the first, second, and third pay lines 13, 11, 15 where the appearance of three like reel symbols may yield a value output to the player, depending on the player's wager cell selection and wager amount.

Unlike column 81, columns 82-84 correspond to the first pay line 13, the second pay line 11, or the third pay line 15, respectively, that include a selected symbol combination defined by the intersecting row of the wager cells 41, 48, 55, 62, 69, or the wager cells 42, 49, 56, 63, 70, or the wager cells 43, 50, 57, 64, 71, respectively. Thus, the columns 82-84 corresponds to one of the three reel symbol positions of the first, second, or third pay lines 13, 11, 15, respectively, where the appearance of three like reel symbols on one of the selected pay lines may yield a value output to the player, depending on the player's wager cell selection and wager amount.

Further, unlike columns 81 and 82-84, columns 85-87 correspond to any displayed position of the first reel 21, the second reel 23, or the third reel 25, respectively that include a selected symbol defined by the intersecting row of the wager cells 44, 51, 58, 65, 72, or the wager cells 45, 52, 59, 66, 73, or the wager cells 46, 53, 60, 67, 74, respectively, rather than to a pay line. Thus, the columns 85-87 correspond to one of any of the three reel symbol positions of the first, second, or third reels 21, 23, 25 where the appearance of an individual symbol may yield a value output to the player, depending on the player's wager cell selection and wager amount.

Although, the illustrated slot game includes three pay lines, it is contemplated that additional pay lines may be included and therefore additional columns reflecting the additional pay lines may be included in the wagering interface 34 and/or only selected pay lines may be reflected by the columns the wagering interface 34. In addition, it is contemplated that the columns may correspond to one of a number of other reel symbol positions in, above, below, or next to a game outcome symbol array.

Wagering Interface—Value Payout Ratios

As previously mentioned, each of the wager cells 40-74 is defined by one row that corresponds to a variation of a first aspect of a particular winning game outcomes and one column that correspond to a variation of a second aspect of the particular winning game outcomes. The particular winning outcome has a corresponding value payout ratio. Rather than being displayed in a separate pay table, the value payout ratios are preferably located with their associated wager cells for ease of viewing by the player. For example, a value payout ratio of 100 to 1 is displayed in the wager cell 47, indicating that if the wager cell 47 is selected, three watermelon reel symbols displayed along any one of the three pay lines 13, 11 or 15 in the game outcome symbol array will yield a value payout that is 100 times the wagered amount. In another example, a value payout ratio of 30 to 1 is displayed in the wager cells 69, 70 and 71, indicating that if the wager cell 70 is selected, three bell reel symbols displayed along the pay line 11 in the game outcome symbol array will yield a value payout that is 30 times the wagered amount. In yet another example, a value payout ratio of 20 to 1 is displayed in the wager cells 44, 45 and 46, indicating that if the wager cell 45 is selected, one 7-symbol appearing on the reel 23 (i.e., the second reel) of the game outcome symbol array will yield a value payout that is 20 times the wagered amount. The value payout ratios increase as the probability of occurrence of the corresponding combination of reel symbol(s) and their position(s) in the game outcome symbol array decrease.

Wagering Interface—Dashboard

Referring again to FIG. 2, the wager interface 34 also includes a dashboard having a credit meter 91 for displaying a number of credits available for game play (e.g., 2000 credits), a cash out button 93 enabling a player to collect unused credits upon completing game play, a total bet meter 94 for displaying the total credits wagered for a current game and a paid meter 95 for displaying credits won for the current game. Also included in the dashboard are player selectable virtual game tokens 96, 97, 98 and 99 having varying denomination values. In the illustrated example, player selection of the virtual game token 96 indicates a one credit wager, player selection of the virtual game token 97 indicates a five credit wager, player selection of the virtual game token 97 indicates a ten credit wager and player selection of the virtual game token 99 indicates a twenty-five credit wager. Player selection of one of the virtual game tokens causes the credit meter 91 to be decremented and the total bet meter 94 to be incremented by the respective wager amount. It is contemplated that other denominations in other configurations are also possible, depending on the wagering game design.

Gaming Machine Components

Figure 3:
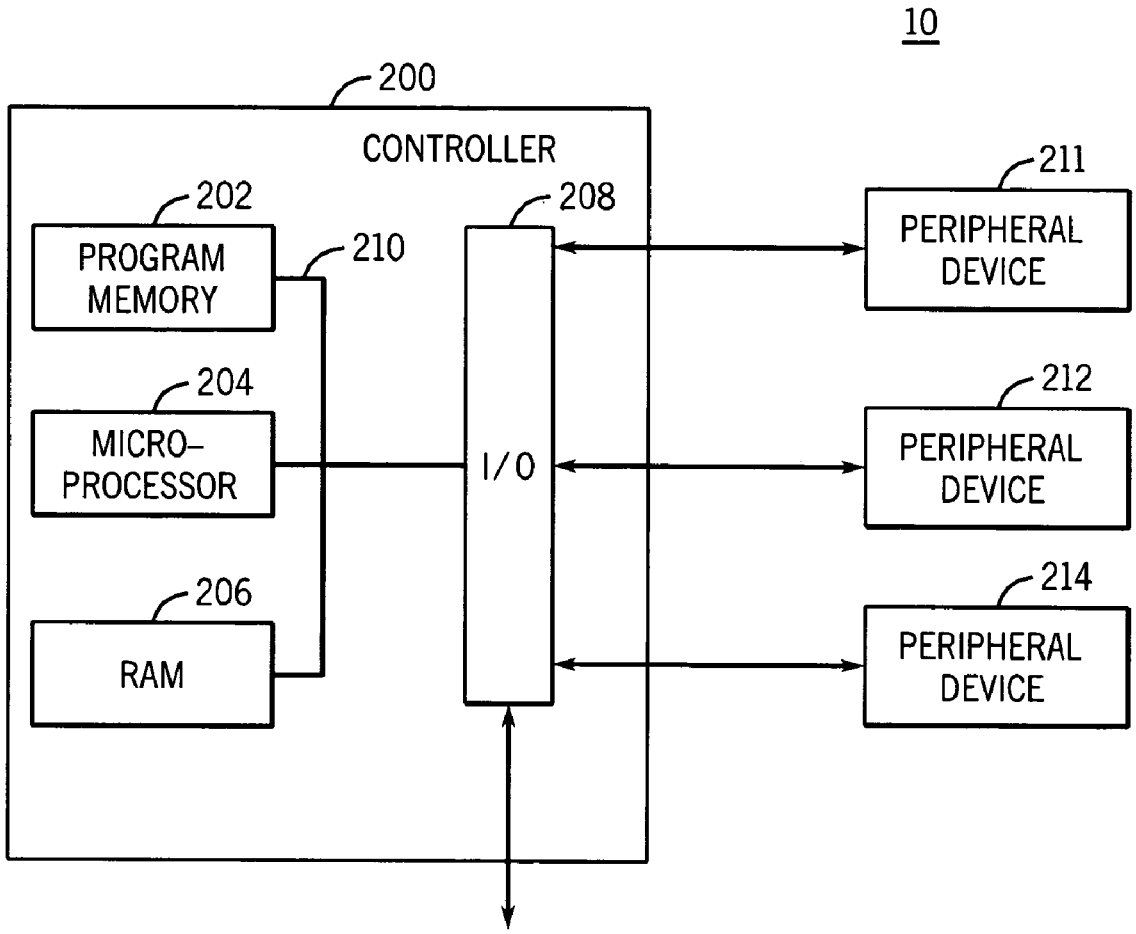
FIG. 3 is a block diagram of the electronic components of the gaming machine of FIG. 1.

FIG. 3 is a block diagram of a number of components that may be incorporated in the gaming machine 10 of FIG. 1. Referring to FIG. 3, the gaming machine 10, includes a controller 200 that may comprise a program memory 202 (including a read only memory (ROM)), a microcontroller-based platform or microprocessor (MP) 204, a random-access memory (RAM) 206 and an input/output (I/O) circuit 208, all of which may be interconnected via a communications link, or an address/data bus 210. The microprocessor 204 is capable of displaying images, symbols and other indicia such as characters, people, places, things, and faces of cards. The RAM 206 is capable of storing event data or other data used or generated during a particular game. The program memory 202 is capable of storing program code that controls the gaming machine 10 so that it plays a particular game in accordance with applicable math models, game rules, and pay tables. For example, when wagering selection is complete, the microprocessor 204, executing code in the program memory 202, determines a game outcome and then causes the first video display to display a game outcome symbol array.

It should be appreciated that although only one microprocessor 204 is shown, the controller 200 may include multiple microprocessors 204. For example, the controller 200 may include one microprocessor for executing low level gaming functions and another processor for executing higher-level game functions such as some communications, security, maintenance, etc. Similarly, the memory of the controller 200 may include multiple RAMs 206 and multiple program memories 202, depending on the requirements of the gaming machine 10. Although the I/O circuit 208 is shown as a single block, it should be appreciated that the I/O circuit 208 may include a number of different types of I/O circuits. The RAM (s) 206 and program memory(s) 202 may be implemented as semiconductor memories, magnetically readable memories, and/or optically readable memories, etc. Further, the term "controller" is used herein to refer collectively to the program memory 202, the microprocessor 204, the RAM 206 and the I/O circuit 208.

FIG. 3 illustrates that multiple peripheral devices, depicted as peripheral devices 211, 212, and 214, may be operatively coupled to the I/O circuit 208. The peripheral devices may include a control panel with buttons, a coin slot acceptor, a note acceptor, a bill validator, a card reader, a sound circuit driving speakers, a card reader display, a first video display, a second video display, a touch screen, etc. In the case of a spinning reel slot machine, the peripheral devices may include a number of electro-mechanical spinning reels and a mechanical arm similarly coupled to the I/O circuit 208. Although three peripheral devices are depicted, more or less peripheral devices may be included.

It should be appreciated that although the controller 200 is a preferable implementation of the present invention, the present invention may also include implementation via one or more application specific integrated circuits (ASICs), field programmable gate arrays (FPGA), adaptable computing integrated circuits, one or more hardwired devices, and/or one or more mechanical devices.

One manner in which the gaming machine 10 may operate is described below in connection with one or more flowchart (s) that represents a number of portions or routines of one or more computer programs, which may be stored in one or more of the memories of the controller 200. The computer program(s) or portions thereof may also be stored remotely, outside of the gaming machine 10 and may therefore control the operation from a remote location.

Referring again to FIGS. 1 and 2, when a player deposits or inserts value in the gaming machine 10, credits corresponding to the value amount deposited are displayed on the credit meter 91. Wagering begins when the player selects, via the wagering interface 34, one of the virtual game tokens 96-99 and one of the wager cells 40-74. In response to detecting player selection of the virtual game token and the wager cell, the controller 200 causes the selected virtual game token to be displayed on the selected wager cell. The player then has the option of repeatedly selecting additional virtual game token (s) 96-99 and wager cell(s) 40-74 and/or beginning game play.

After making wager selections via the wagering interface 34, the player may begin game play by pulling a mechanical arm or by pushing an appropriate button such as a Bet button, a Max Bet button, or a Play button on the player control panel 44. Upon initiating game play, the controller 200 causes the credit meter 91 and the total bet meter 94 to reflect the wager amount(s) placed by the player. The game play outcome, or game outcome symbol array determined by the controller 200, is then displayed to the player and any resulting value output displayed on the paid meter 95 is credited to the player and reflected on the credit meter 91.

The game play outcome displayed by the controller 200 via the first display device 30 may be determined either centrally or locally (1) using a random number generator (RNG) resulting in a pseudo random set of outcomes, or (2) by selecting a game outcome from a fixed set of outcomes (pooled), or (3) other suitable technique.

Exemplary Game Play Routine

Figure 4:
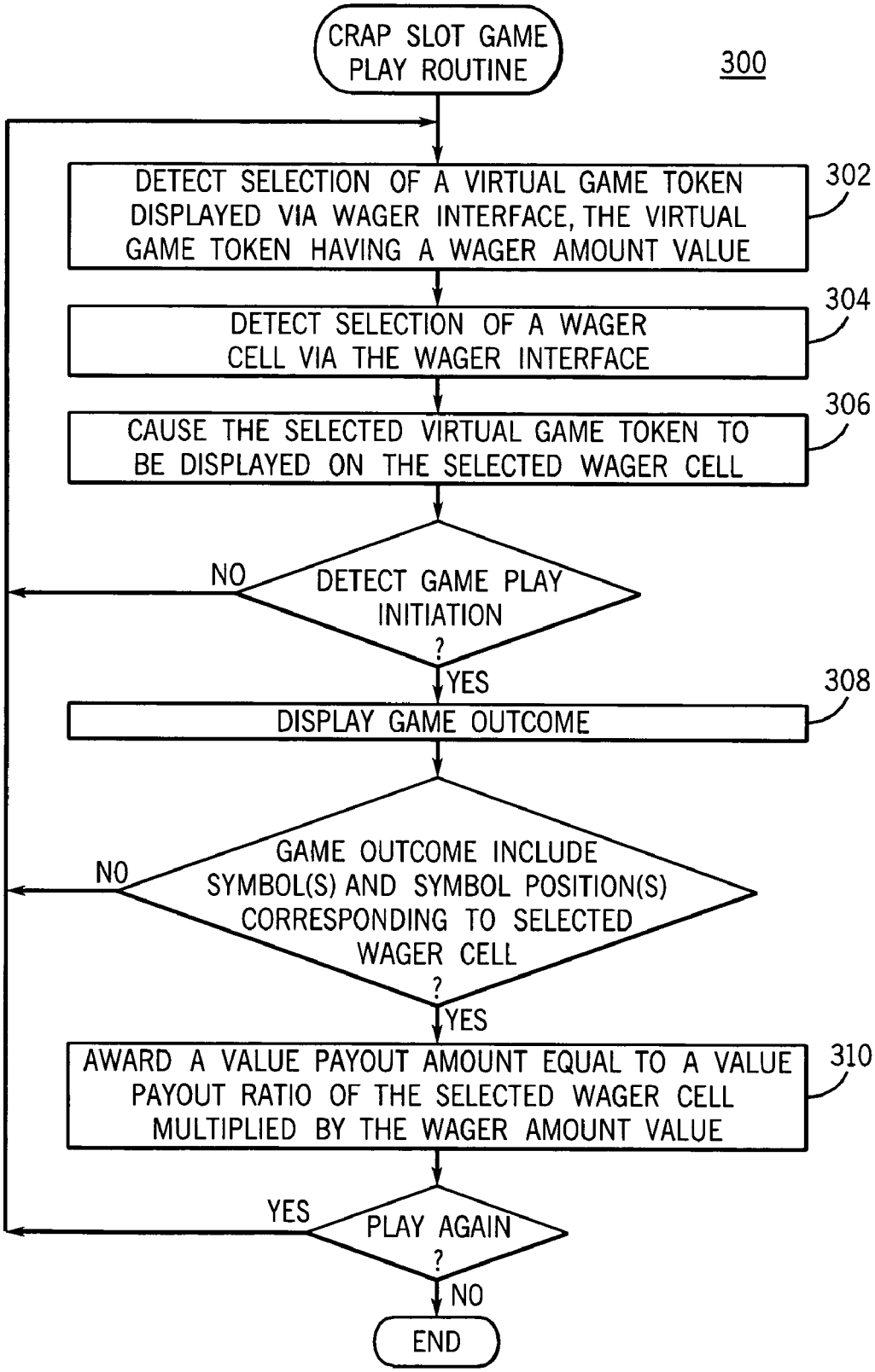
FIG. 4 is a flowchart of an embodiment of a crap slot game play routine that may be performed during game play of the gaming machine of FIG. 1.

FIG. 4 is a flowchart of a crap slot game play routine 300 that may be performed by the controller 200 of the gaming machine 10. Alternatively, the crap slot game play routine 300 may be performed by another controller operatively coupled to the gaming machine 10. The crap slot game play routine 300 provides one example of gaming machine play that includes elements of game table play. Although discussed below in the context of a slot game for illustrative purposes, it is contemplated the slot game of the crap slot game play routine 300 may be replaced by one of any number of other wagering base or bonus games provided by gaming machines.

Referring to FIG. 4, the a crap slot game play routine 300 begins operation when, upon detecting a value input, the controller 200 causes a number of credits corresponding to the value input to be displayed on the credit meter 91. In the illustrated example of FIG. 2, the controller 200 causes 2000 credits to be displayed on the credit meter 91 in response to the value input from the player.

After value input detection, the controller 200 enables player wagering via the wager interface 34 provided by the second video display 32. The player selects both a wager amount and a wager cell to make a wager. For example, upon detecting player selection of one of the virtual game tokens 96-99 (step 302) and one of the wager cells 40-74 (step 304) displayed via the wager interface 34, the controller 200 causes the selected virtual game token to be displayed directly on the selected wager cell (step 306), thereby indicating to the player that the selected wager has been placed. The player may then select one of the virtual game tokens 96-99 and additional wager cells not previously selected, and/or initiate game play.

Figure 5:
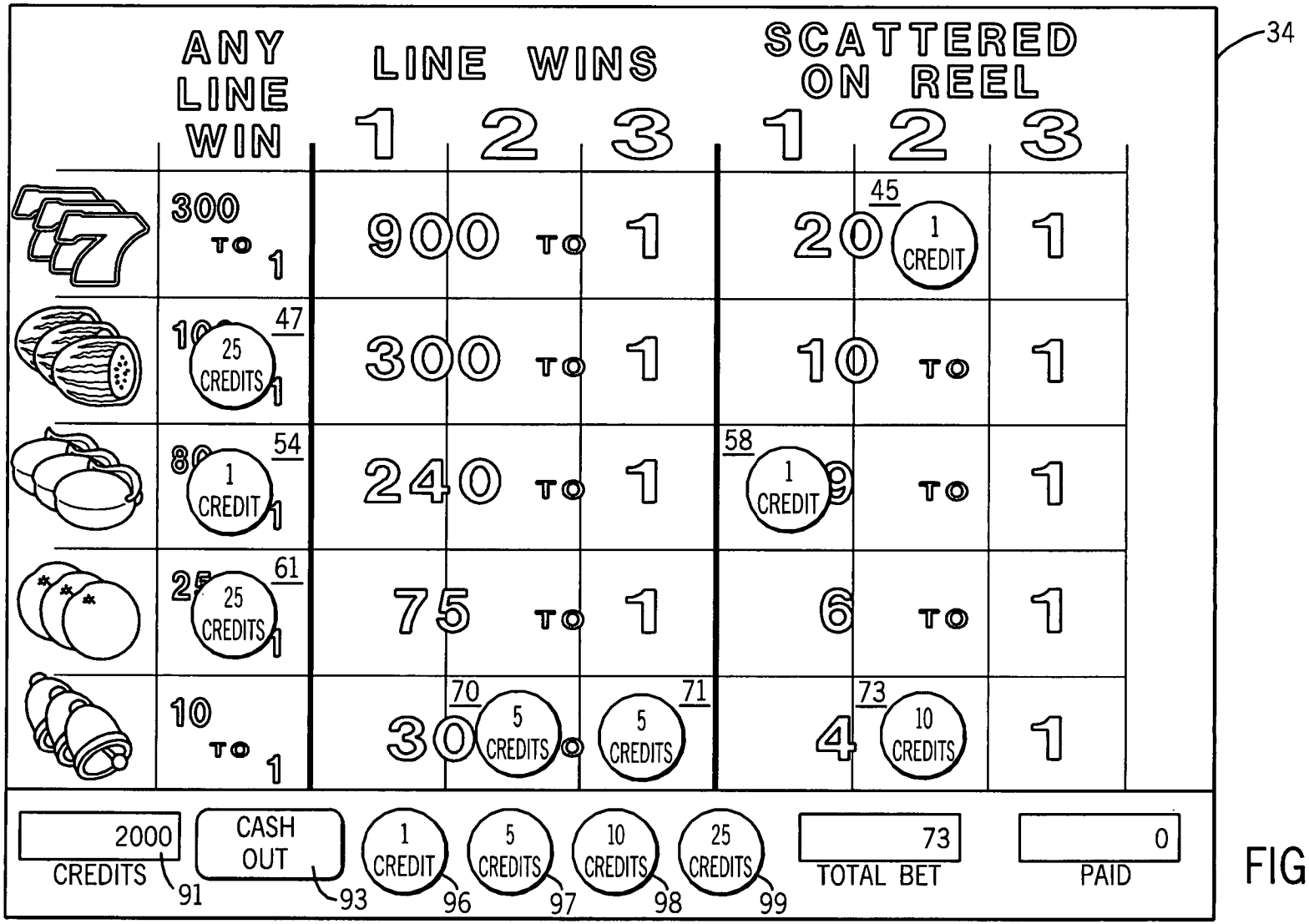
FIG. 5 is the exemplary wagering interface of FIG. 2 during performance of the crap slot game play routine of FIG. 4.

FIG. 5 is an exemplary screen shot that may be displayed after detecting a number of wagers placed by the player for game play on the gaming machine 10. As shown in FIG. 5, the player has (a) selected the virtual game token 99 and the wager cell 61 to place a 25 credit wager having 25 to 1 odds that three orange reel symbols will be displayed on one of any of the three pay lines 11, 13, 15 of the game outcome symbol array, (b) selected the virtual game token 96 and the wager cell 54 to place a 1 credit wager having 80 to 1 odds that three plum reel symbols will be displayed one of any of the three pay lines 11, 13, 15 of the game outcome symbol array, (c) selected the virtual game token 99 and the wager cell 47 to place a 25 credit wager having 100 to 1 odds that three watermelon reel symbols will be displayed one of any of the three pay lines 11, 13, 15 of the game outcome symbol array, (d) selected the virtual game token 97 and the wager cell 70 to place a 5 credit wager having 30 to 1 odds that three bell reel symbols will be displayed on the second pay line 11 of the game outcome symbol array, (e) selected the virtual game token 97 and the wager cell 71 to place a 5 credit wager having 30 to 1 odds that three bell reel symbols will be displayed on the third pay line 15 of the game outcome symbol array, (f) selected the virtual game token 98 and the wager cell 73 to place a 10 credit wager having 4 to 1 odds that one bell reel symbol will be displayed on the second reel 23 (i.e., "scattered" on the second reel) of the three reels 21, 23, 25 providing the game outcome symbol array, (g) selected the virtual game token 96 and the wager cell 58 to place a 1 credit wager having 9 to 1 odds that one plum reel symbol will be displayed on the first reel 21 of the three reels 21, 23, 25 providing the game outcome symbol array, and (h) selected the virtual game token 96 and the wager cell 45 to place a 1 credit wager having 20 to 1 odds that one 7-symbol will be displayed on the second reel 23 of the three reels 21, 23, 25 providing the game outcome symbol array. Thus, the player wagered a total of 73 credits on eight separate wager cells and therefore will receive a value payout if one or more of the eight combinations of reels symbol(s) and reel symbol position(s) (corresponding to the eight selected wager cells) occur in the game outcome symbol array. The value payout will be determined by a number of factors including which of the eight combinations of reels symbol(s) and reel symbol position(s) occurred in the game outcome symbol array, the odds displayed for the corresponding wager cell, and the amount wagered by the player for the corresponding wager cell.

Figure 6:
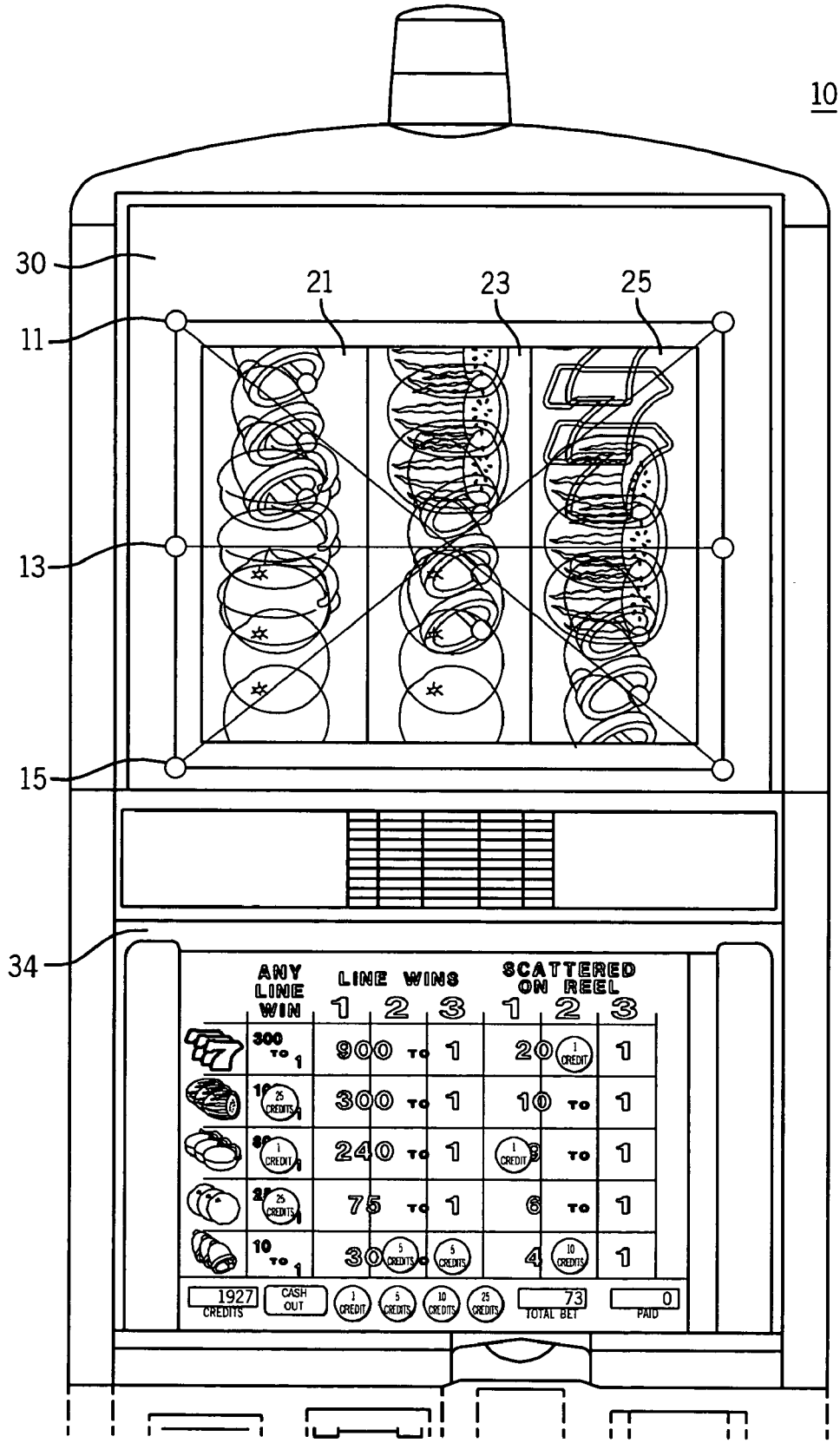
FIG. 6 is a partial view of the gaming machine of FIG. 1 during performance of the crap slot game play routine of FIG. 4.
Figure 7:
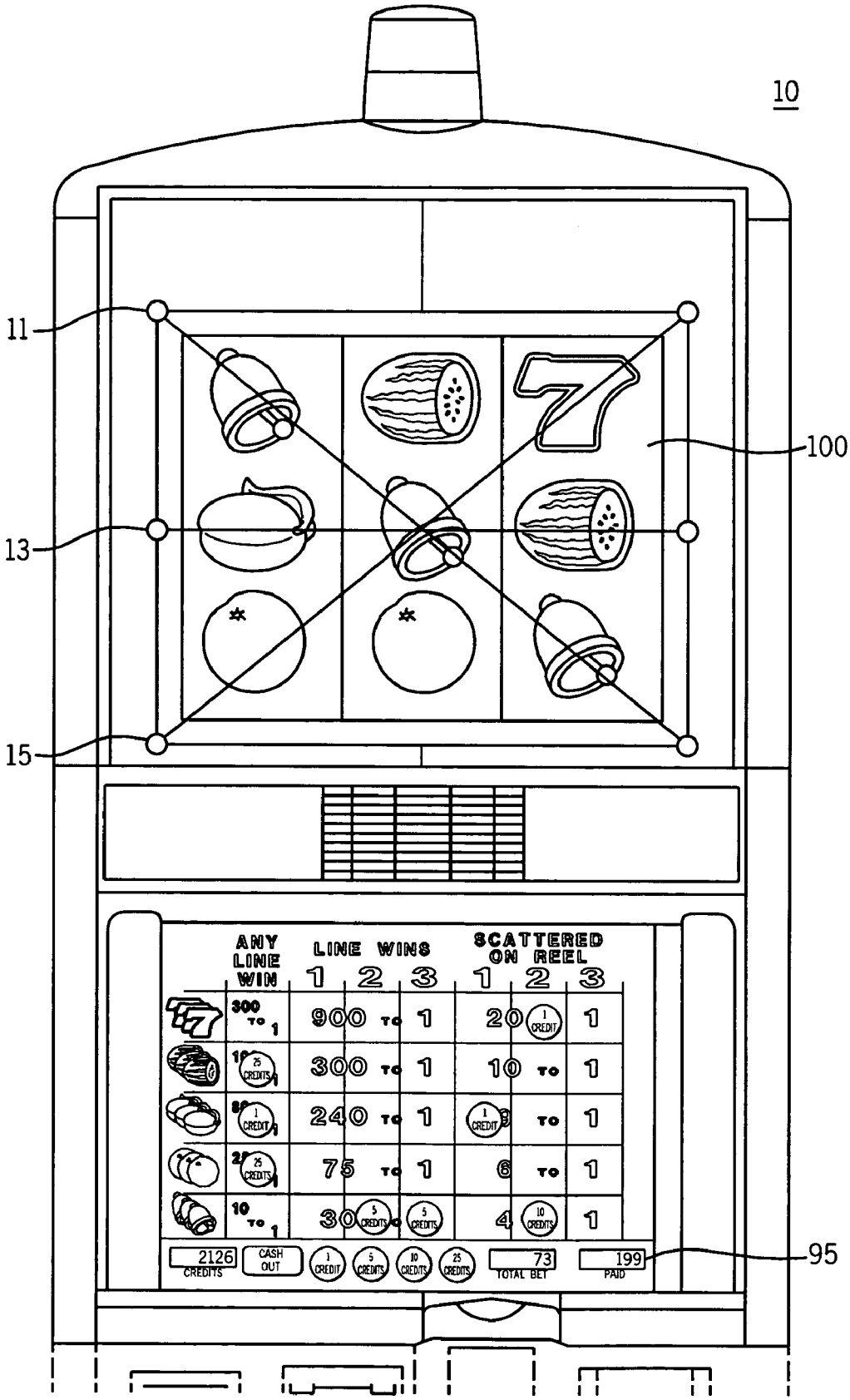
FIG. 7 is another partial view of the gaming machine of FIG. 1 during performance of the crap slot game play routine of FIG. 4.

Referring again to FIG. 4, upon detecting game play initiation (described above in connection with FIG. 1), the controller 200 causes a game outcome to be displayed (step 308); in the instant example, causes the virtual reels to spin and stop to display a game outcome symbol array. For example, FIG. 6 is a partial view of the gaming machine 10 with the virtual reels of the first video display 30 in motion to signify game play as a result of game play initiation. Further, as illustrated by FIG. 7, having determined a game outcome based on operation of a random generator device, the controller 200 stops the reels such that they display a symbol array 100 representing the game outcome.

The symbol array 100 includes three bell reel symbols displayed along the second pay line 11 resulting in a first winning game outcome associated with the 5 credit wager on the wager cell 70 having 30 to 1 odds. The symbol array 100 also includes one plum reel symbol scattered on the first reel 21 resulting in a second winning game outcome corresponding to the 1 credit wager on the wager cell 58 having 9 to 1 odds. Finally, the symbol array 100 includes one bell reel symbol scattered on the second reel 23 resulting in a third winning game outcome corresponding to the 10 credit wager on the wager cell 73 having 4 to 1 odds. Consequently, the total value payout to the player of 199 credits displayed in the paid meter 95 represents three winning game outcomes yielded in one game; 150 credits from the 5 credit wager on the wager cell 70, 9 credits from 1 credit wager on the wager cell 58, and 40 credits from the 10 credit wager on the wager cell 73. In addition to causes the symbol array 100 to be displayed, the controller 200 causes the credit meter 91 to display 2126 credits reflecting the increased difference between the 73 credits wagered and the 199 credits won.

As will be appreciated by those skilled in the art, the present invention provides a gaming machine having a crap slot game play scheme that combines elements of gaming machine play with elements of gaming table play. As a result, the player experiences increased player flexibility in wagering over that provided by typical gaming machine play. In addition, the player has an opportunity to manage the pace of game play and therefore to control their gaming experience.

From the foregoing, it will be observed that numerous variations and modifications may be affected without departing from the scope of the novel concept of the invention. It is to be understood that no limitations with respect to the specific methods and apparatus illustrated herein is intended or should be inferred. It is, of course, intended to cover by the appended claims all such modifications as fall within the scope of the claims.

It is claimed:

1. A method of conducting a wagering game on a gaming machine, the wagering game including a plurality of winning game outcomes, the gaming machine including a controller coupled to at least one display device, the method comprising: detecting player selection of a first wager amount from a plurality of displayed wager amounts of the wagering game; detecting player selection of a first wager cell from a displayed assemblage of wager cells of the wagering game, each of the displayed assemblage of wager cells corresponding to one of the plurality of winning game outcomes, each of the plurality of winning game outcomes having a respective value payout ratio; displaying the game play outcome of the wagering game in response to detecting game play initiation; and awarding a value payout to the player if the game play outcome includes the winning game outcome corresponding to the first wager cell, wherein the wagering game comprises a slot game, the game play outcome including a game outcome reel symbol array having a plurality of reel symbol positions and a plurality of pay lines, and each of the plurality of reel symbol positions being occupied by one of a plurality of reel symbols of the wagering game, and the assemblage of wager cells is arranged in a grid formed by a plurality of rows and a plurality of columns, each row of the plurality of rows corresponding to an occurrence of at least one reel symbol of the plurality of reel symbols, each column of a first group comprising a plurality of columns corresponding to at least one pay line of the plurality of pay lines, and each column of a second group comprising a plurality of columns corresponding to one reel of the slot game.

2. The method of claim 1, further comprising displaying the first wager amount in the first wager cell in response to detecting player selection of the first wager amount and the first wager cell.

3. The method of claim 1, further comprising: prior to the step of displaying the game play outcome, detecting player selection of a second wager amount from the plurality of displayed wager amounts; prior to the step of displaying the game play outcome, detecting player selection of a second wager cell from the displayed assemblage of wager cells; displaying the second wager amount in the second wager cell in response to detecting player selection of the second wager amount and the second wager cell; and awarding the value payout to the player if the game play outcome includes the winning game outcome corresponding to the second wager cell.

4. The method of claim 3, wherein the first wager amount is equivalent to the second wager amount.

5. The method of claim 1, wherein the value payout is based on the first wager amount and the value payout ratio of the winning game outcome corresponding to the first wager cell.

6. The method of claim 1, wherein each of the value payout ratios is based on a probability of the respective each of the plurality of winning game outcomes occurring in the game play outcome.

7. The method of claim 1, wherein the plurality of displayed wager amounts and the plurality of displayed wager cells and the game play outcome are displayed via the at least one display device.

8. The method of claim 1, wherein the game play outcome is displayed via a first display device, and wherein the plurality of displayed wager amounts and the plurality of displayed wager cells are displayed via a second display device.

9. The method of claim 8, wherein the first display device is selected from the group consisting of a video display device and a plurality of symbol bearing electro-mechanical reels.

10. The method of claim 8, wherein the second display device is selected from the group consisting of a player responsive video display device and a player responsive flat panel transmissive display configured to overlay a plurality of video images upon a portion of the gaming machine.

11. The method of claim 1, wherein the slot game comprises a three reel slot game, and wherein game outcome reel symbol array includes nine reel symbol positions and three pay lines.

12. A method of conducting a wagering game on a gaming machine, the wagering game including a plurality of winning game outcomes, the gaming machine including a controller coupled to a first and a second display device, the method comprising: detecting player selection of a first wager amount from a plurality of wager amounts displayed via a wagering interface provided by the second display device; detecting player selection of a first wager cell from an assemblage of wager cells displayed via the wagering interface, each of the assemblage of wager cells corresponding to one of the plurality of winning game outcomes, each of the plurality of winning game outcomes having a respective value payout ratio; detecting player selection of a second wager amount from the plurality of displayed wager amounts; detecting player selection of a second wager cell from the displayed assemblage of wager cells; displaying the first wager amount in the first wager cell and displaying the second wager amount in the second wager cell; displaying the game play outcome of the wagering game on the first display device in response to detecting game play initiation; and awarding a value payout to the player if the game play outcome includes at least one of the winning game outcomes corresponding to the first wager cell and the second wager cell, wherein the wagering game comprises a slot game, the game outcome reel symbol array including a plurality of reel symbol positions and a plurality of pay lines, each row of the plurality of rows corresponding to an occurrence of at least one reel symbol of the plurality of reel symbols, each column of a first group comprising a plurality of columns corresponding to at least one pay line of the plurality of pay lines, and each column of a second group comprising a plurality of columns corresponding to one reel of the slot game.

13. The method of claim 12, wherein the first wager amount is equivalent to the second wager amount.

14. The method of claim 12, wherein each of the value payout ratios is based on a probability of the respective each of the plurality of winning game outcomes occurring in the game play outcome.

15. The method of claim 12, wherein the first display device is selected from the group consisting of a video display device and a plurality of symbol bearing electro-mechanical reels.

16. The method of claim 12, wherein the second display device is selected from the group consisting of a player responsive video display device and a player responsive flat panel transmissive display configured to overlay a plurality of video images upon a portion of the gaming machine.

17. The method of claim 12, wherein the game outcome reel symbol array includes nine reel symbol positions and three pay lines.

18. A gaming machine for providing crap slot game play, the gaming machine comprising: at least one display device; and a controller coupled to the at least one display device, the controller including a processor and a memory coupled to the controller, the controller being programmed to: detect player selection of a first wager amount from a plurality of wager amounts displayed via the at least one display device, detect player selection of a first wager cell from an assemblage of wager cells displayed via the at least one display device, each of the assemblage of wager cells corresponding to one of the plurality of winning game outcomes, each of the plurality of winning game outcomes having a respective value payout ratio, in response to detecting game play initiation, display the game play outcome of the wagering game via the at least one display device, and awarding a value payout to the player if the game play outcome includes the winning game outcome corresponding to the first wager cell, wherein the wagering game comprises a slot game, the game play outcome including a game outcome reel symbol array having a plurality of reel symbol positions and a plurality of pay lines, each of the plurality of reel symbol positions occupied by one of a plurality of reel symbols of the wagering game, and the assemblage of wager cells is arranged in a grid formed by a plurality of rows and a plurality of columns, each row of the plurality of rows corresponding to an occurrence of at least one reel symbol of the plurality of reel symbols, each column of a first group comprising a plurality of columns corresponding to at least one pay line of the plurality of pay lines, and each column of a second group comprising a plurality of columns corresponding to one reel of the slot game.

19. The gaming machine of claim 18, wherein the controller is further programmed to display the first wager amount in the first wager cell in response to detecting player selection of the first wager amount and the first wager cell.

20. The gaming machine of claim 18, wherein the controller is further programmed to: prior to the step of displaying the game play outcome, detect player selection of a second wager amount from the plurality of wager amounts; prior to the step of displaying the game play outcome, detect player selection of a second wager cell from the assemblage of wager cells; display the second wager amount in the second wager cell in response to detecting player selection of the second wager amount and the second wager cell; and award the value payout to the player if the game play outcome includes the winning game outcome corresponding to the second wager cell.

21. The gaming machine of claim 18, wherein the game play outcome is displayed via a first display device, and wherein the plurality of wager amounts and the plurality of wager cells are displayed via a second display device.

22. The gaming machine of claim 21, wherein the first display device is selected from the group consisting of a video display device and a plurality of symbol bearing electromechanical reels.

23. The gaming machine of claim 21, wherein the second display device is selected from the group consisting of a player responsive video display device and a player responsive flat panel transmissive display configured to overlay a plurality of video images upon a portion of the gaming machine.

* * * * *